United States Patent [19]

Vyne et al.

[11] Patent Number: 4,716,356

[45] Date of Patent: Dec. 29, 1987

[54] JFET PINCH OFF VOLTAGE PROPORTIONAL REFERENCE CURRENT GENERATING CIRCUIT

[75] Inventors: Robert L. Vyne, Tempe; David M. Susak, Mesa, both of Ariz.

[73] Assignee: Motorola, Inc., Schaumburg, Ill.

[21] Appl. No.: 943,341

[22] Filed: Dec. 19, 1986

[51] Int. Cl.[4] ..... G05F 3/08

[52] U.S. Cl. ..... 323/312; 307/491

[58] Field of Search ..... 323/312, 313; 307/491, 307/501, 571

[56] References Cited

U.S. PATENT DOCUMENTS 4,449,067 5/1984 Nishikawa ..... 307/570

4,645,998 2/1987 Shinohara et al. ..... 323/313

*Primary Examiner*—Patrick R. Salce

*Assistant Examiner*—Jeffrey Sterrett

*Attorney, Agent, or Firm*—Vincent B. Ingrassia

[57] ABSTRACT

A circuit for generating a reference current proportional over temperature to the pinch-off voltage of a first JFET includes second and third JFETS and first and second resistors. The second JFET has its gate coupled to its source and produces a current which drives the first JFET. Since the width-to-length ratio of the second JFET is greater than that of the first, a negative gate-to-source voltage of the first JFET is produced across the first resistor. The third JFET has a source coupled via the second resistor to the gate of the first JFET and has a gate coupled to the drain of the first JFET for setting the voltage thereat. The reference current appears at the drain of the third JFET.

4 Claims, 2 Drawing Figures

– PRIOR ART –

JFET PINCH OFF VOLTAGE PROPORTIONAL REFERENCE CURRENT GENERATING CIRCUIT

BACKGROUND OF THE INVENTION

This invention relates generally to a current source circuitry, and more particularly to a circuit for generating a reference current which is proportional over temperature to the ratio of the pinch-off voltage ($V_P$) of a standard junction field effect transistor (JFET) to some resistance.

As is well known, the pinch off voltage $V_P$ is the voltage at which there is substantially zero source-to-drain current in a JFET. That is, no current will flow in the JFET if the JFET's gate is pulled high enough in voltage with respect to its source. Up to now, this could be accomplished only by using a very large area JFET and placing a large resistance between its gate and source terminals.

A reduction in the size of the JFET has been accomplished by incorporating into the circuit a large NPN transistor and a diode. In either event, large devices have been necessary which occupy a significant amount of die area.

SUMMARY OF THE INVENTION

It is an object of the invention to provide an improved circuit for generating a reference current proportional over temperature to the ratio of the pinch-off voltage $V_P$ of a standard JFET to some resistance.

It is a further object of the present invention to provide a circuit for generating a reference current which is proportional over temperature to the ratio of the pinch-off voltage of a JFET to some resistance and which is independent of the size of the JFETs utilized.

In accordance with a broad aspect of the invention there is provided a circuit for generating a reference current proportional over temperature to the ratio of the pinch-off voltage $V_P$ of a JFET to some resistance, comprising a JFET having a source coupled to a first source of supply voltage, a gate, and a drain; first means coupled to the drain of the JFET for imparting a negative gate-to-source voltage on the JFET; and first resistive means coupled between the gate and source of the JFET for producing the reference current.

The above and other objects, features and advantages of the present invention will be more clearly understood from the following detailed description taken in conjunction with the accompanying drawings, in which:

DESCRIPTION OF THE PREFERRED EMBODIMENT

Figure 1:
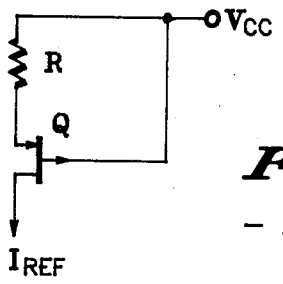
FIG. 1 is a schematic diagram of a circuit for generating a reference current proportional to $V_P$ in accordance with the prior art.

FIG. 1 is a schematic diagram of a circuit for generating a reference current ($I_{ref}$) proportional to the pinch-off voltage $V_P$ of JFET Q. As cas be seen, a resistor R is placed between its source and gate, and the desired reference current appears at its drain. Both the gate of JFET Q and its source (via resistor R) are coupled to a source of supply voltage $V_{CC}$. It is well known that $$V_{gs} = V_P(1 - \sqrt{I_{ref}/I_{DSS}}) = I_{ref}R \quad (1)$$

where $V_{gs}$ is the gate-to-source voltage of JFET Q and $I_{DSS}$ represents the current through JFET Q when its gate is tied to its source. It is to be noted that $I_{DSS}$ is strictly a function of the size of JFET Q. If $I_{ref}$ is substantially less than $I_{DSS}$ then $$V_{gs} \approx V_p \approx I_{ref}R \quad (2)$$

$$I_{ref} \approx V_P/R \quad (3)$$

It can be seen, however, that for a reasonable value of $I_{ref}$ (e.g. 100 microamps) then $I_{DSS}$ must be approximately equal to 10 times $I_{ref}$ or one milliamp in order to satisfy the requirement that $I_{ref}$ be substantially less than $I_{DSS}$. In order to achieve an $I_{DSS}$ of one milliamp, the width-to-length ratio Z/L of the JFET must be approximately 125. Assuming that $V_P$ is equal to one volt, then $$R = V_P/I_{ref} = 10K\Omega \quad (4)$$

Figure 2:
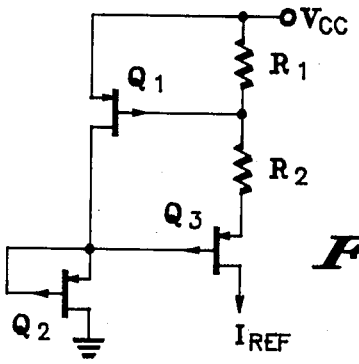
FIG. 2 is a schematic diagram of a circuit for generating a reference current proportional over temperature to $V_P$ in accordance with the present invention.

FIG. 2 is a schematic diagram of a current source which generates a reference current proportional over temperature to $V_P$ wherein $I_{ref}$ is independent of the size of the JFETs employed. A first JFET $Q_1$ has its source coupled to a source of supply voltage $V_{CC}$ and its gate coupled via a resistor $R_1$ to $V_{CC}$. A second JFET $Q_2$ has its source coupled to its gate and to the drain of JFET $Q_1$. The drain of JFET $Q_2$ is coupled to ground. Finally, a third JFET $Q_3$ has its source coupled via resistor $R_2$ to the gate of JFET $Q_1$ and has a gate coupled to the source and gate terminals of JFET $Q_2$. The function of JFETQ3 is to set the voltage at the source of JFETQ2 by providing negative feedback. The desired reference current $I_{ref}$ appears at the drain of JFET $Q_3$.

JFET $Q_2$ having its source tied to its gate develops a current $I_{DSSQ2}$ which is proportional to its size as previously described. JFET $Q_2$ is also chosen to be slightly larger than JFET Q1, therefore, $I_{DSSQ2}$ is greater than $I_{DSSQ1}$. Since $I_{DSSQ2}$ is being driven through JFET Q1, the gate to source voltage of $Q_1$ is negative (e.g. 50–100 milivolts). Thus, $$V_{sgQ1} = V_P(-1 + \sqrt{I_{DSSQ2}/I_{DSSQ1}}) \quad (5)$$

Since $$I_{D3} = V_{sgQ1}/R_1 = I_{ref} \quad (6)$$

where $I_{D3}$ is the drain current of JFET Q3, then $$I_{D3} = V_P/R_1(\sqrt{I_{DSSQ2}/I_{DSSQ1}} - 1) \quad (7)$$

Solving for $R_1$ yields $$R_1 = V_P/I_{D3}(\sqrt{I_{DSSQ2}/I_{DSSQ1}} - 1) \quad (8)$$

Assume that $V_P$ equal one volt, $I_{DSS}$ equals 8 microamps per Z/L, $I_{D3}$ equals 100 microamps and that the (Z/L) of JFETS Q1, Q2 and Q3 are 5, 6, and 8.6 respectively. Substituting into equation 8 yields an R1 equal to 954 ohms.

$I_{DSSQ3}$ may be determined from the following equation:

$$V_{gsQ3} = V_P(\sqrt{100\,A/I_{DSSQ3}} - 1) \quad (9)$$

Solving for $I_{DSSQ3}$ yields $I_{DSSQ3}=69$ microamps. Therefore, Z/L of $Q_3$ equals 8.6.

Thus it can be seen that the total Z/L of the circuit shown in FIG. 2 is 19.6 while that of the prior art circuit shown in FIG. 1 was 125. Furthermore, the total resistance of the circuit shown in FIG. 2 is somewhat reduced from that shown in FIG. 1. Finally, the desired reference current $I_{ref}$ equals $I_{D3}$ as is shown in equation 6. It is not an approximation as was the case with the prior art circuit as shown by equation 3.

The above description is given by way of example only. Changes in form and details may be made by one skilled in the art without departing from the scope of the invention as defined by the appended claims.

We claim:

1. A circuit for generating a reference current proportional over temperature to the ratio of the pinch off voltage $V_p$ of a JFET to some resistance, comprising:

a first JFET having a source coupled to a first source of supply voltage, a gate, and a drain;

first means coupled to the drain of said first JFET for imparting a negative gate-to-source voltage on said first JFET;

first resistive means coupled between the gate and source of said first JFET for producing said reference current; and second means coupled to the gate and drain of said first JFET for setting the voltage at the drain of said first JFET.

2. A circuit according to claim 1 wherein said first means comprises a second JFET having a gate and source coupled together and to the drain of said first JFET and having a drain coupled to a second source of supply voltage.

3. A circuit according to claim 2 wherein the width-to-length ratio of said first JFET is less than the that of said second JFET.

4. A circuit according to claim 3 wherein said second means comprises:

second resistive means having a first terminal coupled to the gate of said first JFET; and a third JFET having a source coupled to the second terminal of said second resistive means, a gate coupled to the drain of said first JFET and a drain for conducting said reference current.

* * * * *